US009625858B2

(12) United States Patent
Izutani et al.

(10) Patent No.: US 9,625,858 B2
(45) Date of Patent: Apr. 18, 2017

(54) INTERMEDIATE TRANSFER BELT, AND IMAGE FORMING APPARATUS USING THE BELT

(71) Applicants: Akira Izutani, Osaka (JP); Hideaki Yasunaga, Tokyo (JP); Makoto Matsushita, Tokyo (JP); Hiroaki Takahashi, Kanagawa (JP); Keiichiro Juri, Kanagawa (JP); Ayano Momose, Tokyo (JP); Yuri Haga, Kanagawa (JP)

(72) Inventors: Akira Izutani, Osaka (JP); Hideaki Yasunaga, Tokyo (JP); Makoto Matsushita, Tokyo (JP); Hiroaki Takahashi, Kanagawa (JP); Keiichiro Juri, Kanagawa (JP); Ayano Momose, Tokyo (JP); Yuri Haga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/049,697

(22) Filed: Feb. 22, 2016

(65) Prior Publication Data

US 2016/0259273 A1 Sep. 8, 2016

(30) Foreign Application Priority Data

Mar. 5, 2015 (JP) ..... 2015-043563

(51) Int. Cl.
*G03G 15/16* (2006.01)

(52) U.S. Cl.
CPC ... *G03G 15/162* (2013.01); *G03G 2215/1623* (2013.01)

(58) Field of Classification Search
CPC ..... G03G 15/162; G03G 2215/1623
USPC ..... 399/302, 303, 308, 162, 174, 239, 278, 399/288, 329, 352; 430/125.32; 428/65.9, 113, 297.4, 299.7, 298.1
See application file for complete search history.

(56) References Cited

U.S. PATENT DOCUMENTS

| | | | | |
|---|---|---|---|---|
| 6,263,183 | B1 * | 7/2001 | Schlueter, Jr. ..... | G03G 15/2057 399/307 |
| 9,256,176 | B2 * | 2/2016 | Miyahara ..... | G03G 15/2057 |
| 2003/0054279 | A1 | 3/2003 | Yamaguchi et al. | |
| 2003/0143000 | A1 | 7/2003 | Takahashi et al. | |
| 2003/0224279 | A1 | 12/2003 | Kotsugai et al. | |
| 2004/0142269 | A1 | 7/2004 | Kotsugai et al. | |
| 2005/0064315 | A1 | 3/2005 | Yamaguchi et al. | |
| 2005/0147436 | A1 * | 7/2005 | Koyama ..... | G03G 15/206 399/329 |
| 2006/0204882 | A1 | 9/2006 | Nozaki et al. | |
| 2006/0210908 | A1 | 9/2006 | Umemura et al. | |
| 2006/0275686 | A1 | 12/2006 | Kadota et al. | |
| 2007/0059625 | A1 | 3/2007 | Yamamoto et al. | |
| 2007/0122729 | A1 | 5/2007 | Katoh et al. | |

(Continued)

FOREIGN PATENT DOCUMENTS

| | | | |
|---|---|---|---|
| JP | 04159938 A | * | 6/1992 |
| JP | 10-048963 | | 2/1998 |

(Continued)

*Primary Examiner* — Robert Beatty
(74) *Attorney, Agent, or Firm* — Cooper & Dunham LLP

(57) ABSTRACT

An intermediate transfer belt includes a thermoplastic resin and a fibrous material. The fibrous material has an orientation angle Fa of from 5° to 30° in a direction perpendicular to a circumferential direction of the intermediate transfer belt.

7 Claims, 5 Drawing Sheets

(56) References Cited

U.S. PATENT DOCUMENTS

2007/0148568 A1 6/2007 Kadota et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0238042 A1 10/2007 Yasunaga et al.
2008/0038656 A1 2/2008 Yasunaga et al.
2008/0063957 A1 3/2008 Murakami et al.
2008/0069594 A1 3/2008 Izutani
2008/0069598 A1 3/2008 Murakami et al.
2008/0069599 A1 3/2008 Nakamura et al.
2008/0069605 A1 3/2008 Fuwa et al.
2008/0069608 A1 3/2008 Katoh et al.
2008/0070149 A1 3/2008 Kato et al.
2008/0153018 A1 6/2008 Mikuriya et al.
2008/0159777 A1 7/2008 Fuwa et al.
2008/0175630 A1 7/2008 Yasunaga et al.
2008/0199234 A1 8/2008 Hagi et al.
2008/0226356 A1 9/2008 Yasunaga et al.
2008/0226997 A1 9/2008 Nakamura et al.
2008/0227009 A1 9/2008 Fuwa et al.
2008/0232849 A1 9/2008 Izutani et al.
2008/0232864 A1 9/2008 Izutani et al.
2008/0233506 A1 9/2008 Hagi et al.
2008/0279591 A1 11/2008 Yasunaga et al.
2008/0304875 A1 12/2008 Katoh et al.
2009/0041511 A1 2/2009 Fuwa et al.
2009/0052952 A1 2/2009 Katoh et al.
2009/0060540 A1 3/2009 Matsushita et al.
2009/0117481 A1 5/2009 Yasunaga et al.
2009/0142107 A1 6/2009 Akira et al.
2009/0169270 A1 7/2009 Fuwa et al.
2009/0180791 A1 7/2009 Matsushita et al.
2009/0186289 A1 7/2009 Nakamura et al.
2009/0186291 A1 7/2009 Mikuriya et al.
2009/0190949 A1 7/2009 Hamahashi et al.
2009/0196638 A1 8/2009 Sukesako et al.
2009/0238585 A1 9/2009 Hayashi et al.
2009/0257792 A1 10/2009 Nakamura et al.
2009/0279909 A1 11/2009 Matsushita et al.
2009/0324270 A1 12/2009 Yamashita et al.
2010/0009282 A1 1/2010 Katoh et al.
2010/0055603 A1 3/2010 Nozaki et al.
2010/0167196 A1 7/2010 Hagi et al.
2010/0272481 A1 10/2010 Yamamoto et al.
2010/0296848 A1 11/2010 Yamamoto et al.
2011/0008069 A1 1/2011 Matsushita et al.
2011/0217653 A1 9/2011 Izutani et al.
2011/0243616 A1 10/2011 Nakagawa et al.
2011/0249994 A1 10/2011 Matsushita et al.
2012/0003415 A1* 1/2012 Fromm ..... G03G 15/2014 428/36.91
2012/0237270 A1 9/2012 Juri et al.
2012/0294657 A1 11/2012 Matsushita et al.
2012/0315067 A1 12/2012 Takahashi
2013/0058685 A1 3/2013 Juri et al.
2014/0212184 A1 7/2014 Juri et al.
2014/0243465 A1 8/2014 Matsushita et al.
2014/0321888 A1 10/2014 Yasunaga et al.
2015/0014602 A1 1/2015 Matsushita et al.
2015/0078777 A1 3/2015 Juri et al.
2015/0078790 A1 3/2015 Ishikawa et al.
2015/0078791 A1 3/2015 Momose et al.
2015/0189759 A1* 7/2015 Rovere ..... H05K 3/0055 174/262
2015/0258712 A1* 9/2015 Moser ..... D04H 3/115 428/113
2016/0004191 A1 1/2016 Juri et al.

FOREIGN PATENT DOCUMENTS

JP 11301824 A * 11/1999
JP 2007086133 A * 4/2007
JP 2007-178750 7/2007
JP 2013037213 A * 2/2013

* cited by examiner

INTERMEDIATE TRANSFER BELT, AND IMAGE FORMING APPARATUS USING THE BELT

CROSS-REFERENCE TO RELATED APPLICATIONS

This patent application is based on and claims priority pursuant to 35 U.S.C. §119 to Japanese Patent Application No. 2015-043563, filed on Mar. 5, 2015, in the Japan Patent Office, the entire disclosure of which is hereby incorporated by reference herein.

BACKGROUND

Technical Field

The present invention relates to an intermediate transfer belt and an image forming apparatus using the belt.

Description of the Related Art

Conventionally, a seamless belt is used in various applications as a member in image forming apparatus. Particularly, in recent full-color image forming apparatuses, intermediate transfer belt methods overlapping four color, i.e., yellow, magenta, cyan and black developed images on an intermediate transfer medium once, and transferring the overlapped full-color images on a transfer medium such as papers at a time are used.

The intermediate transfer belt is produced by a batch production method using a curing resin and a continuous extrusion method using a thermoplastic resin. It is already known that the continuous extrusion method using a thermoplastic resin is advantageous to reduce environmental load and cost. The thermoplastic resin has an elasticity of from 1,000 MPa to 4,000 MPa when molded into an intermediate transfer belt. However, the belt having an elasticity not less than 2,000 MPa has high surface hardness, resulting in being easy to crack, difficult to stably mold, and needing high molding temperature although having high scratch resistance and producing no stripe images. Therefore, the thermoplastic resin preferably has an elasticity of from 1,000 MPa to 2,000 MPa when molded into an intermediate transfer belt.

However, although reducing environmental load and being low-cost, the belt having an elasticity of from 1,000 MPa to 2,000 MPa has low surface (Martens) hardness, and has scratches and stripes on an inner circumferential surface thereof due to convexities and concavities of rollers such as a drive roller, a suspension roller and a roller opposite to a belt cleaner, resulting in production of abnormal images. For example, when the suspension roller has microscopic convexities and concavities from the beginning or due to adherence of foreign particles, when foreign particles such as a metallic powder and an aggregated toner adhere to the backside of the belt, and/or when scratches are formed on the surface of a roller, convexities and concavities corresponding to the microscopic convexities and concavities, the shape of the metallic powder or the aggregated toner, and/or the scratches formed on the surface of a roller are formed on the surface of the belt.

FIG. 1 is a photograph taken by an optical microscope of an example of scratches formed on an inner circumferential surface of the belt due to convexities and concavities on a roller (200 times). The scratches have a length of from 5 μm to 20 μm and a depth (height) of from 1 μm to 2 μm. The convexities and concavities on the surface of the belt cause stripe images because of poor contact thereof to a toner image. In order to avoid scratches on an inner circumferential surface of the belt, 1) a method of reducing the surface roughness of the suspension roller suspending the belt, 2) a method of placing a cleaning member for one of the suspension rollers to remove foreign particles adhering thereto, 3) a method of making a friction coefficient of the surface of a roller not greater than 0.25 or lower than a friction coefficient of the surface of the belt, and 4) a method of reducing roughness of the backside of the belt are suggested.

SUMMARY

An intermediate transfer belt includes a thermoplastic resin and a fibrous material. The fibrous material has an orientation angle Fa of from 5° to 30° in a direction perpendicular to a circumferential direction of the intermediate transfer belt.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
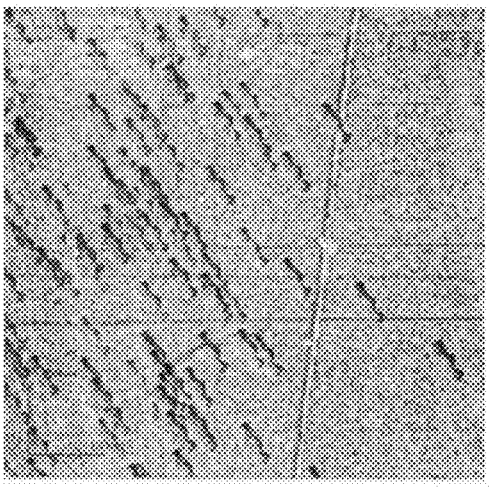
FIG. 1 is a photograph taken by an optical microscope of scratches formed on an inner circumferential surface of the belt due to convexities and concavities on a roller.

An object of the present invention is to provide an intermediate transfer belt capable of inhibiting scratches from being formed on an inner circumferential surface of the belt to suppress production of abnormal images.

Another object the present invention is to provide an image forming apparatus using the intermediate transfer belt.

The present invention provides an intermediate transfer belt capable of inhibiting scratches from being formed on an inner circumferential surface of the belt to suppress production of abnormal images, and an image forming apparatus using the intermediate transfer belt.

More particularly, the present invention relates to an intermediate transfer belt including a thermoplastic resin; and a fibrous material, wherein the fibrous material has an orientation angle Fa of from 5° to 30° in a direction perpendicular to a circumferential direction of the intermediate transfer belt.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Specific examples of the thermoplastic resins for use in the present invention include, but are not limited to, polyolefin resins such as polyethylene and polypropylene; and fluororesins such as polyvinylidene fluoride. Polystyrene, polymethylacrylate, polyvinyl chloride, polybutadiene, natural rubbers, polyvinyl alcohol, polyamide, etc. can also be used. Among these, polyvinylidene fluoride having incombustibility is preferably used.

Polyvinylidene fluoride resins include a homopolymer of vinylidene fluoride and a copolymer of vinylidene fluoride and a comonomer. The comonomer includes hexafluoropropylene and tetrafluoroethylene. The copolymer include the comonomer in an amount of from about 5% to 15% by mol.

Specific examples of the fibrous materials include natural fibers such as cotton, hemp, silk, and wool; chemical fibers such as rayon, cupra, acetate, promix, nylon, acrylic, vinylon, vinylidene, polyvinyl chloride, polyester, polyethylene, polypropylene, benzoate and polyclar: and special function fibers such as ceramic fibers, glass fibers, aramid fibers, phenol fibers, polyurethane fibers, fluorine fibers. These fibers can be used alone or in combination. Above all, in terms of improving effects of the present invention, natural fibers and chemical fibers are preferably used.

The fibrous material preferably has an average outer diameter of from 10 μm to 50 μm, and is preferably a short fiber having an average length of from 200 μm to 1,000 μm in terms of improving effects of the present invention. The average outer diameter and the average length can be measured by randomly sampling 300 SEM images of the fibrous material and analyzing the image information by an image analyzer.

The intermediate transfer belt preferably includes the fibrous material in its layer including the inner circumferential surface in an amount of from 0.5% to 10.0% by weight, and more preferably from 1.0% to 5.0% by weight.

[Orientation Angle Fa]

Figure 2:
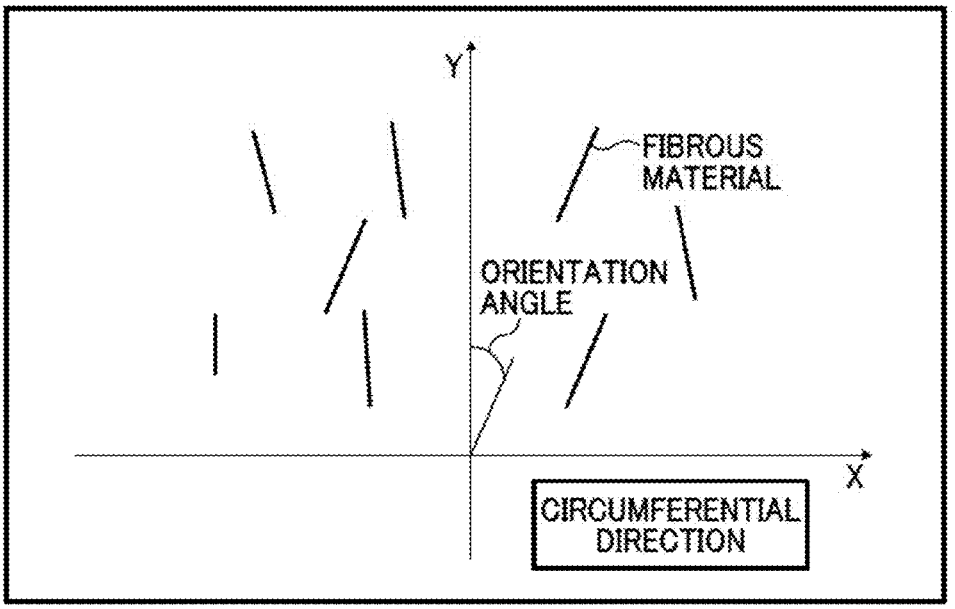
FIG. 2 is a schematic view for explaining a method of calculating the orientation angle Fa.

The orientation angle Fa in the present invention is measured as follows. The surface of the inner circumferential surface of the molded intermediate transfer belt is observed by SEM (1,000 to 10,000 times) to obtain image data. One hundred (100) fibrous materials are abstracted. As FIG. 2 shows, orientation angles of the fibrous materials when a (Y) direction perpendicular to a belt circumferential (X) direction is 0° are measured in a range of anticlockwise −90° or clockwise 90° on the basis of the Y direction. An average of absolute values of the orientation angles is the orientation angle Fa.

For example, the orientation angle Fa of the fibrous material can be adjusted as follows.

The orientation angle of the fibrous material can be adjusted by conditions of drawing the thermoplastic resin from a circular dice when extruded. In addition, fine particles are included to decrease a degree of orientation.

When an intermediate transfer belt is molded by extrusion, a thickness thereof is adjusted by an extrusion quantity of the resin and a drawing (extension) speed of the belt from an extruder. The extrusion quantity of the resin is determined by a viscosity thereof, a rotational number of the screw of the extruder and a nozzle area (rip width) of a belt molding die.

The orientation angle Fa of a fiber is controlled by a viscosity and a flow speed of the resin in an extruder or a die, and an extension speed after extruded. The viscosity is decreased, the flow speed is increased (the extrusion quantity of the resin is increased) and the drawing speed is increased to decrease the orientation angle Fa of a fiber. These processes are reversed to increase the orientation angle Fa of a fiber.

Fine particles may be included in a resin composition to interfere with the orientation angle of a fiber. The fine particles include typical inorganic and organic fine particles. Particularly, polymeric or crosslinked organic fine particles having the same composition as that of the main resin having good compatibility therewith are used to obtain a belt having good surfaceness.

Besides, flow of the resin may be interfered in the extruder or the die. Preferably, a rib generating turbulence or a resin pool is located in the die.

In the present invention, the fibrous material needs to have an orientation angle Fa of from 5° to 30°. When less than 5° or greater than 30°, the effect of the present invention is difficult to exert. The orientation angle Fa is preferably from 5° to 15°.

Next, components addable to the intermediate transfer belt of the present invention are explained.

[Conductive Resin]

The intermediate transfer belt of the present invention preferably includes a conductive resin formed of a polymer having a polyether unit, particularly a conductive resin having crystallinity in terms of bending resistance. A polymeric ion conductive agent including a polyether amide component, a polyether ester amide component or a polyester-ether block copolymer component is preferably used. Further, the intermediate transfer belt preferably includes a low-molecular-weight ion conductive agent. As the polyether amide component and the polyether ester amide component, polyether component preferably includes ($CH_2$—$CH_2$—O—) and polyamide component preferably includes polyamide 12 or polyamide 6.

A block copolymer repeatedly and alternately combining a unit of hydrophilic polymer and a unit of hydrophobic polymer such as polyolefin through ester bonds, amide bonds, ester bonds, urethane bonds, imide bonds, etc. is preferably used as well. The polyolefin includes polyolefin having a functional group such as carboxyl group, hydroxyl group and amino group at both ends of the polymer, and particularly polypropylene and polyethylene are preferably used.

The hydrophilic polymer includes polyether diol such as polyoxyalkylene having a hydroxyl group; polyether ester amide constituted of polyamide having carboxyl groups at both ends and polyether diol; polyether amide imide constituted of polyamide imide and polyether diol; polyether ester constituted of polyester and polyether diol; polyetherimide constituted of polyamide and polyether diamine; etc. Among these, polyoxyalkylene having a hydroxyl group is preferably used. Specific examples thereof include polyoxyethylene (polyethylene glycol) and polyoxypropylene (polypropylene glycol) having hydroxyl groups at both ends.

The conductive resin preferably includes an inorganic or organic salt because of having stable conductivity. In addition, the conductive resin may include an antioxidant and a radical scavenger. Specific examples of the inorganic or organic salt include alkali metals of an inorganic or a low-molecular-weight proton acid; alkali earth metals; and zinc or ammonium salts, such as $LiClO_4$, $LiCF_3SO_3$, $NaClO_4$, $LiBF_4$, $NaBF_4$, $KBF_4$, $NaCF_3SO_3$, $KClO_4$, $KPF_6$, $KCF_3SO_3$, $KC_4F_9SO_3$, $Ca(ClO_4)_2$, $Ca(PF_6)_2$, $Mg(CLO_4)_2$, $Mg(CF_3SO_3)$, $Zn(ClO_4)_2$, $Zn(PF_6)$ and $Ca(CF_3SO_3)_2$.

The conductive resin preferably has a volume resistivity of from $10^2$ to $10^{10}$ (Ω·cm), and more preferably from $10^4$ to $10^8$ (Ω·cm).

The intermediate transfer belt preferably includes the conductive resin in an amount of from 1% to 10% by weight. When not less than 1% by weight, the resistance can be decreased. When not greater than 10% by weight, the belt is difficult to tear, crack or contaminate such as filming.

[Fine Particles]

Further, the intermediate transfer belt of the present invention preferably includes an organic and/or an inorganic fine particles having an average particle diameter of from 1 μm to 5 μm.

The fine particles have the shape of a sphere, a needle or a disc. The fine particle preferably have a primary particle diameter of from about 0.01 μm to 1 μm.

Materials for the fine particles include an electron conductive agent and an ion conductive agent. Organic and inorganic fillers are preferably used.

Specific examples of the electron conductive agent include conductive carbons such as KETJEN BLACK and acetylene black; carbons for rubber such as SAF, ISAF, HAF, FEF, GPF, SRF, FT and MT; oxidized carbons for colors (ink); thermolysis carbons, nature graphite; artificial graphite; metals and metal oxide such as antimony-doped tin oxide, titanium oxide, zinc oxide, nickel, copper, silver, germanium; conductive polymer such as polyaniline, polypyrrole and polyacetylene; and conductive whiskers such as a carbon whisker, a black lead whisker, a carbonization titanium whisker, a conductive potassium whisker titanate, a conductivity barium titanate whisker, a conductive titanium oxide whisker and a conductive zinc oxide whisker.

Specific examples of the ion conductive agents include ammonium salts such as perchlorates, chlorates, hydrochlorides, bromates, iodates, borofluoride hydroacid salts, sulfates, ethyl sulfates, carboxylates and sulfonates of tetraethyl ammonium, tetrabutyl ammonium, dodecyl trimethyl ammonium, hexadecyl trimethyl ammonium, benzyl trimethyl ammonium and modified fatty acid dimethyl ethyl ammonium; and those of lithium, sodium, potassium, calcium, alkali metals and alkaline earth metals.

The intermediate transfer belt preferably includes the fine particles in an amount of from 0.5% to 10.0% by weight, and more preferably from 1.0% to 5.0% by weight.

[Preparation Method]

The intermediate transfer belt of the present invention may have a single-layered structure or a multilayered structure, and preferably has a double-layered structure including a substrate layer and a surface layer. A resin for the substrate layer and a resin for the surface layer are extruded together to form the two layers at the same time or they are formed in turn. It is preferable to extrude together to obtain desired high surface glossiness and good adhesiveness of an interface between the two layers.

Polyolefin resins and fluorine resins are preferably used for the thermoplastic resin in the substrate layer. The polyolefin resins include polyethylene, polypropylene, etc., and the fluorine resins include polyvinylidene fluoride. Besides, polystyrene, polymethylacrylate, polyvinylidene chloride, polybutadiene, natural rubbers, polyvinylalcohol, polyamide, etc. can also be used. Among these, polyvinylidene fluoride having incombustibility is preferably used.

Polyvinylidene fluoride resins include a homopolymer of vinylidene fluoride and a copolymer of vinylidene fluoride and a comonomer. The comonomer includes hexafluoropropylene and tetrafluoroethylene. The copolymer include the comonomer in an amount of from about 5% to 15% by mol.

The thermoplastic resin in the surface layer may be the same as those of the substrate layer. The surface layer preferably does not include a conductive agent or a filler to have good surfaceness.

When the substrate layer and the surface layer are extruded together, two extruders extruding materials for each layer and one ring-shaped dice for the two layers are used. The melted materials for each layer are placed in the ring-shaped dice at the same time, layered in the dice and extruded. A layered intermediate transfer belt is prepared in a short time in one process. To prepare a belt including 3 or more layers, the number of extruders and dices are changed in accordance with the number of the layers.

[Image Forming Apparatus]

Next, the image forming apparatus of the present invention is explained. The image forming apparatus includes at least an electrostatic latent image former to form an electrostatic latent image on an image bearer, an image developer to develop the electrostatic latent image formed on the image bearer with a toner to form a toner image, a first transferer to transfer the toner image on the image bearer onto an intermediate transfer belt, a second transferer to transfer the toner image on the intermediate transfer belt onto a recording medium, and a fixer to fixing the toner image on the recording medium. The intermediate transfer belt includes a fibrous material having a specific orientation angle Fa.

Figure 3:
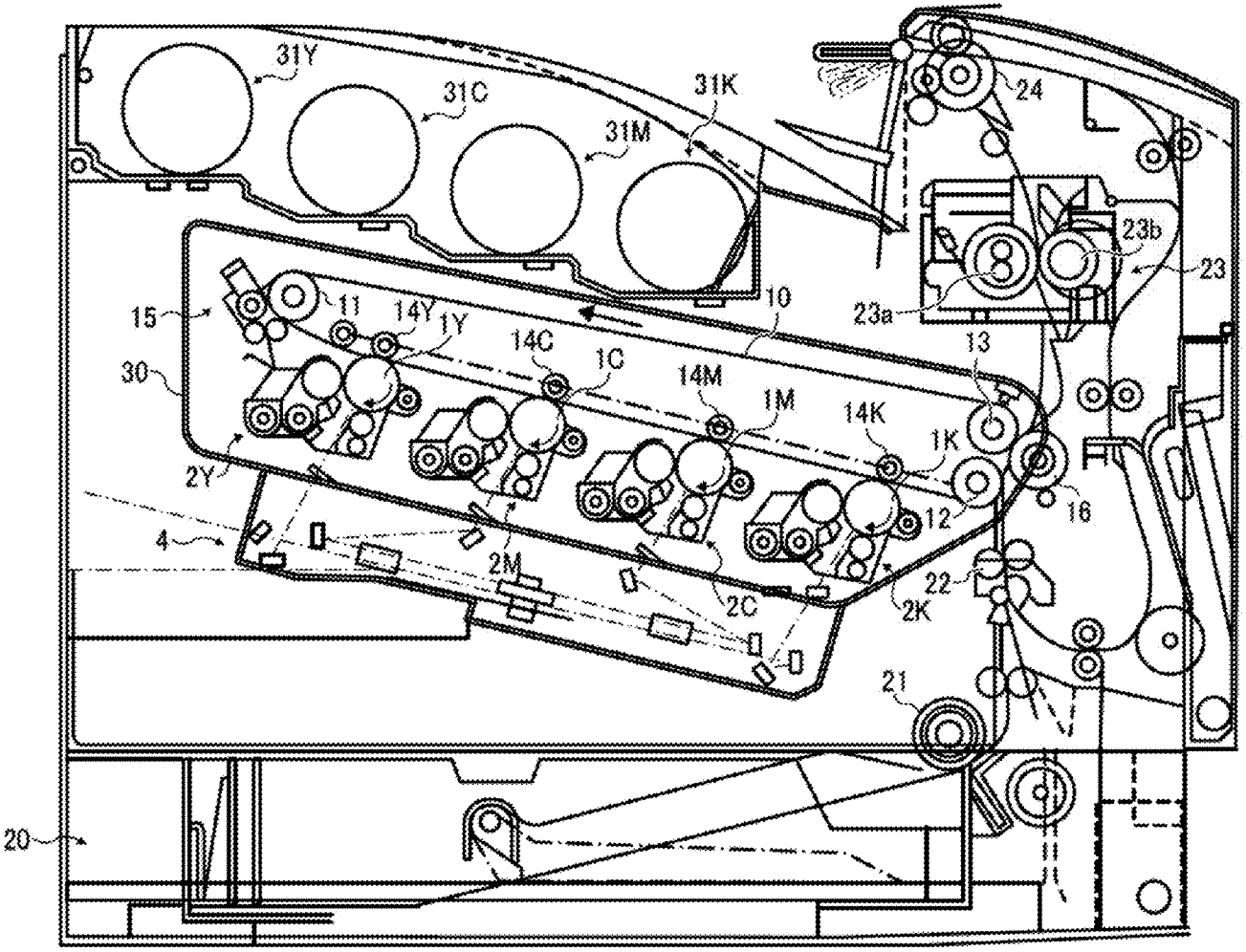
FIG. 3 is a schematic cross-sectional view illustrating an embodiment of the image forming apparatus of the present invention.

FIG. 3 is a schematic view illustrating an embodiment of the image forming apparatus of the present invention.

The image forming apparatus forms a color image with four colors, yellow (Y), cyan (C), magenta (M), and black (K) toners.

The image forming apparatus has a basic configuration of tandem-type image forming apparatus including plural image bearers lined in a travel direction of a surface travel member.

The image forming apparatus includes four photoconductor drums 1Y, 1C, 1M and 1K as electrostatic latent image bearers. They are drum-shaped photoconductors and may be belt-shaped photoconductors. Each of the photoconductor drums 1Y, 1C, 1M and 1K rotates in an arrow direction while contacting an intermediate transfer belt 10. Each of the photoconductor drums 1Y, 1C, 1M and 1K includes a thin cylindrical electroconductive substrate, a photosensitive layer on the substrate, and a protection layer on the photosensitive layer. An intermediate layer may be formed between the photosensitive layer and the protection layer.

Figure 4:
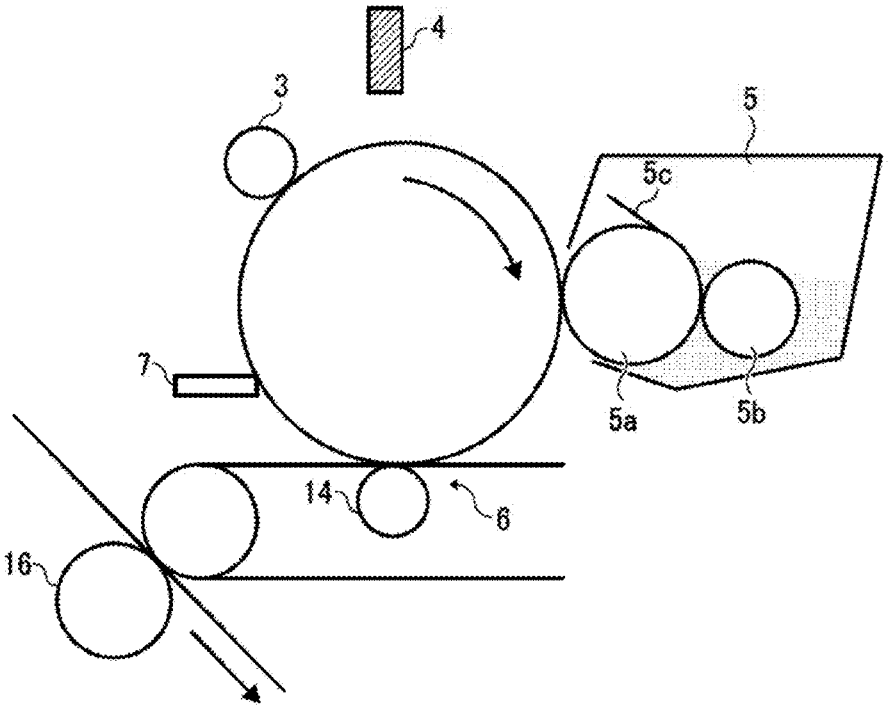
FIG. 4 is a schematic cross-sectional view illustrating a configuration of image forming portion including a photoconductor.

FIG. 4 is a schematic view illustrating a configuration of image forming unit 2 in which photoconductors are located. Configurations around each of photoconductors 1Y, 1C, 1M and 1K in the image forming unit 2Y, 2C, 2M and 2K are the same, and only one of the image forming units 2 is illustrated and Y, C, M and K to identify colors are omitted.

Around the photoconductor 1, along its surface travel direction, a charger 3, an image developer 5, a transferer 6 to transfer a toner image on the photoconductor 1 onto a recording medium or an intermediate transfer belt 10, and a cleaner 7 to remove an untransferred toner on the photoconductor 1 are located in this order. Between the charger 3 and the image developer 5, there is a space for an irradiator 4 to emit light and irradiate the surface of the charged photoconductor 1 with the light to form an electrostatic latent image thereon on the basis of image data.

The charge 3 negatively charges the surface of the photoconductor 1. The charge 3 includes a charging roller charging by a contact/proximity charging method. Namely, the charger 3 contacts or brings the charging roller close to the surface of the photoconductor 1 and applies a negative bias to the charging roller to charge the surface of the photoconductor 1. A direct current (DC) charging bias is applied to the charging roller such that the photoconductor 1 has a surface potential of −500 V. An alternate current (AC) bias may be overlapped with the DC bias. The charger 3 may include a cleaning brush to clean the surface of the charging roller. A thin film may be wound around both ends of charging roller in an axial direction thereof such that the ends wound with the film contact the surface of the photoconductor 1. The surface thereof is extremely close to the surface of the charging roller with only a gap which is a thickness of the film. A charging bias is applied to the charging roller to generate an electric discharge between the surface of the charging roller 3*a* and the surface of the photoconductor 1 to charge the surface of the photoconductor 1. The charged surface of the photoconductor 1 is irradiated by the irradiator 4 and an electrostatic latent image correspondent to each color is formed thereon. The irradiator 4 writes an electrostatic latent image correspondent to each color on the photoconductor 1, based on image information correspondent to each color. The irradiator uses a laser, and may use an LED array and an image formation means.

A toner fed from each of toner bottles 31Y, 31C, 31M and 31K into the image developer 5 is transferred by a developer feed roller 5*b* an borne on a developing roller 5*a*. The developing roller 5*a* is transferred to a developing area opposite to the photoconductor 1, where the developing roller 5*a* moves at a linear speed higher than that of the surface of the photoconductor 1 in the same direction. The developing roller 5*a* feeds the toner on the surface of the photoconductor 1 while scraping the surface thereof. An electrostatic force directs the toner on the developing roller 5*a* to the electrostatic latent image such that the toner adheres thereto. Thus, the electrostatic latent image on the photoconductor 1 is developed into a toner image correspondent to each color.

The intermediate transfer belt 10 in the transferer 6 s suspended and extended by three support rollers 11, 12 and 13, and endlessly travels in an arrow direction. Toner images on the photoconductors 1Y, 1C, 1M and 1K are overlappingly transferred on the intermediate transfer belt 10 by an electrostatic transfer method. The electrostatic transfer method may use a transfer charger, but uses first transfer rollers 14Y, 14C, 14M and 14K in the present invention. Specifically, the first transfer roller 14 is located as a transferer 6 at a part of the backside of the intermediate transfer belt 10 contacting each of the photoconductors 1Y, 1C, 1M and 1K. A first transfer nip is formed between the part of the intermediate transfer belt 10 pressed by each of the first transfer rollers 4Y, 14C, 14M and 14K and each of the photoconductors 1Y, 1C, 1M and 1K. A bias having a positive polarity is applied to the first transfer roller 14 when a toner image is transferred onto the intermediate transfer belt 10. A transfer electric field is formed at the first transfer nip and the toner image on each of the photoconductors 1Y, 1C, 1M and 1K is electrostatically transferred onto the intermediate transfer belt 10. Then, the photoconductor 1 and the intermediate transfer belt 10 preferably contact each other with pressure. The pressure is preferably from 10 to 60 N/m.

Around the intermediate transfer belt 10, a belt cleaner 15 is located to remove a toner remaining on the intermediate transfer belt 10. The belt cleaner 15 collects an unnecessary toner adhering to the surface of the intermediate transfer belt 10 with a fur brush or a cleaning blade. The collected unnecessary toner is transported to an unillustrated waste toner tank by an unillustrated transporter from the belt cleaner 15. A second transfer roller 16 is located contacting a part of the intermediate transfer belt 10 suspended and extended by a support roller 13. A second transfer nip is formed between the intermediate transfer belt 10 and the second transfer roller 16, which a transfer paper as a recording member is fed to at a predetermined time. The transfer paper is contained in a paper feed cassette 20 below the irradiator 4, and fed to the second transfer nip by a paper feed roller 21, a registration roller 22, etc. The toner images superimposed on the intermediate transfer belt 10 are transferred onto a transfer paper at a time at the second transfer nip. A bias having a positive polarity is applied to the second transfer roller 16 at the second transfer, to form a transfer electric field transferring the toner images superimposed on the intermediate transfer belt 10 are transferred onto the transfer paper.

A heating fixer 23 as a fixing means is located in a paper feed direction at downstream side of the second transfer nip. The heating fixer 23 is formed of a heat roller 23*a* including a heater and a pressure roller 23*b* applying a pressure. A transfer paper having passed the second transfer nip is sandwiched between the rollers to receive heat and pressure. Thereby, the toner on the transfer paper is melted and fixed thereon. The transfer paper the toner image is fixed on is discharged by a paper discharge roller 24 onto a paper tray on the image forming apparatus.

The image developer 5 partially exposes the developing roller 5*a* as a developer bearer from an opening of its casing. A one-component develop not including a carrier is used. The image developer 5 contains a toner from each of the toner bottles 31Y, 31C, 31M and 31K. Each of the toner bottles 31Y, 31C, 31M and 31K is detachable from an image forming apparatus alone, which saves cost.

Figure 5:
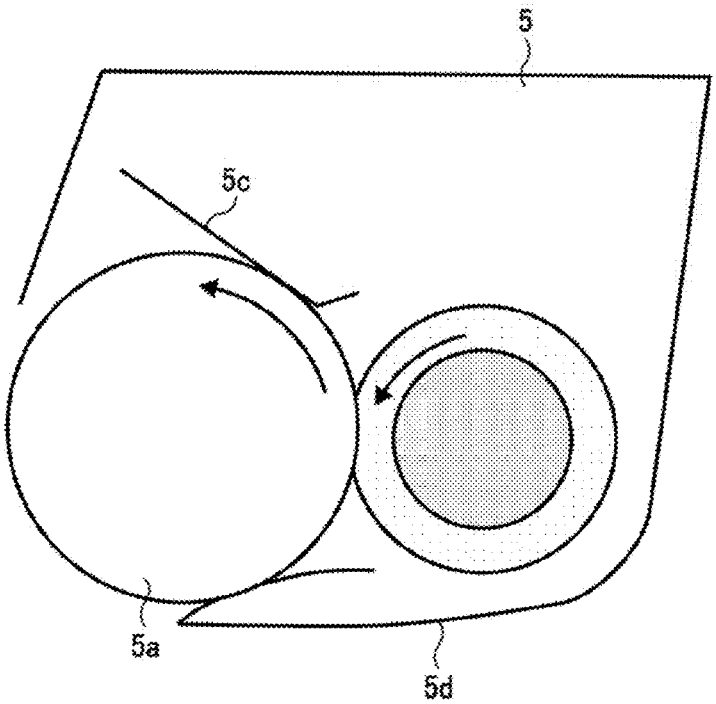
FIG. 5 is a schematic cross-sectional view illustrating a configuration of an image developer.

FIG. 5 is a schematic cross-sectional view illustrating a configuration of an image developer.

A developer (toner) in a developer container is conveyed to a nip of the developing roller 5*a* as a developer bearer bearing the developer on the surface to feed the developer to the photoconductor 1 while stirred by a feed roller 5*b* as a developer feed member. Then, the feed roller 5*b* and the developing roller 5*a* rotate in opposite (counter) directions of each other. Further, a regulation roller 5*c* as a developer layer regulation member contacting the developing roller 5*a* regulates a toner quantity thereon to form a toner thin layer thereon. In addition, the toner is frictionized at a nip between the feed roller 5*b* and the developing roller 5*a*, and between the regulation blade 5*c* and the developing roller 5*a* to be properly charged.

Figure 6:
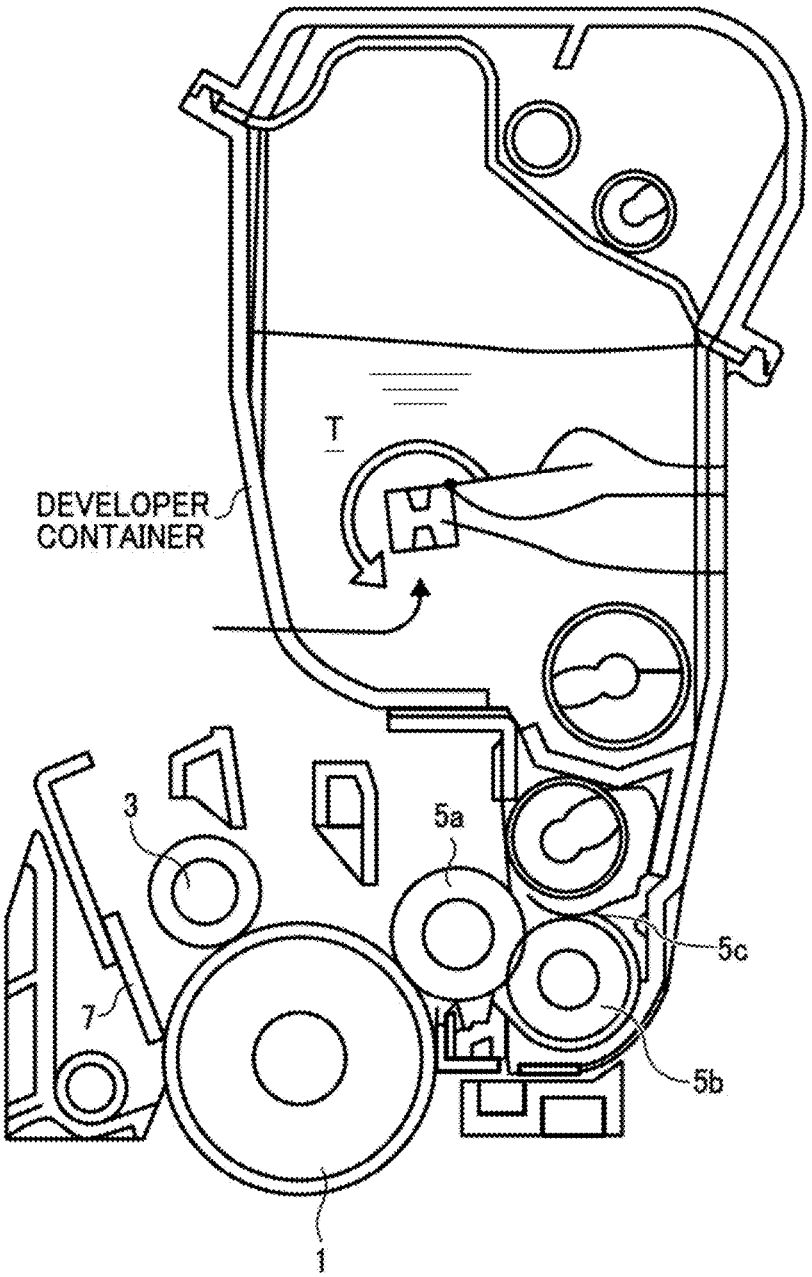
FIG. 6 is a schematic cross-sectional view illustrating an embodiment of process cartridge.

FIG. 6 is a schematic cross-sectional view illustrating an embodiment of process cartridge.

In the present invention, at least two of configurations such as an electrostatic latent image bearer, a charger, an image developer are combined as a process cartridge which is detachable from an image forming apparatus such as copiers and printers. The process cartridge in FIG. 6 includes an electrostatic latent image bearer 1, a charger 3 and an image developer 5 explained in FIG. 5.

Figure 7:
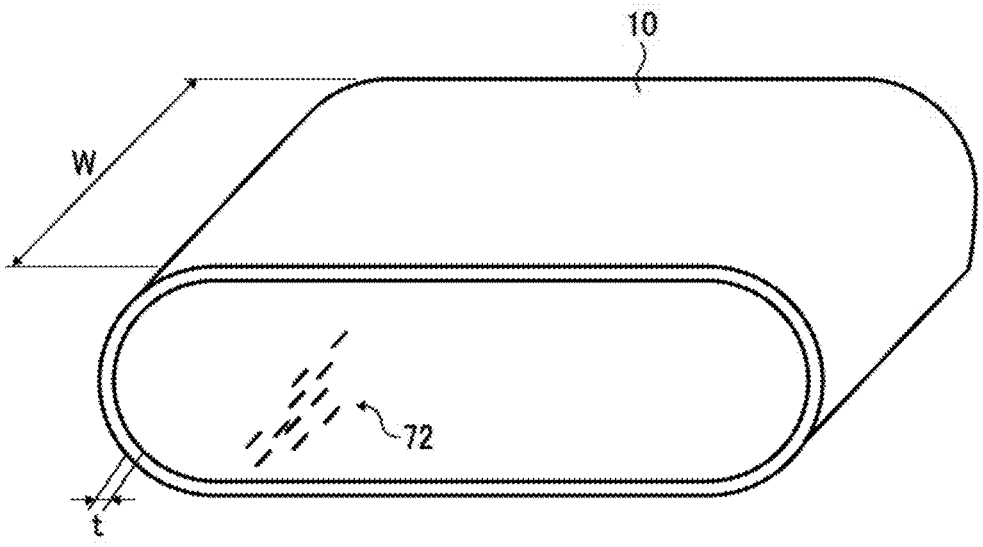
FIG. 7 is a schematic view illustrating an external appearance of an embodiment of the intermediate transfer belt of the present invention.

FIG. 7 is a schematic view illustrating an embodiment of the intermediate transfer belt of the present invention. As FIG. 7 shows, the double-layered intermediate transfer belt 10 including a substrate layer and a surface layer includes a fibrous material 72 having an orientation angle Fa of from 5° to 30°.

The intermediate transfer belt 10 is almost a cylinder-shaped endless belt and freely deformable, having flexibility. In FIG. 7, the belt is suspended over two rolls to have the shape of a long circle. The intermediate transfer belt 10 has an outer diameter of from 100 mm to 300 mm, a width of from 100 mm to 350 mm when having the shape of a cylinder, and a thickness of from 50 μm to 300 μm. The intermediate transfer belt 10 has a tensile elasticity of from 800 MPa to 4,000 Mpa and a surface resistivity of from $1.0\times10^{6}\Omega/\square$ to $1.0\times10^{12}\Omega/\square$.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Examples 1 to 9

Method of Preparing Fibrous Material

A fiber material was placed in a cutter mill and cut short at 10,000 rpm for 15 min at room temperature. The fiber was further pulverized by a pulverizer DD-2 from Makino Mfg. Co., Ltd., and coarse fibers were removed to prepare a fibrous material for use in the present invention.

[Preparation of Fibrous Material]

Fibers having an outer diameter of from 5 μm to 100 μm (materials are shown in Tables 1 and 2) were processed to fibrous materials by the above-mentioned method. The pulverizer was activated at 6,000 rpm and a pulverization time was properly adjusted to prepare each of fibrous materials having an average outer diameter and an average length shown in Tables 1 and 2.

[Molding of Intermediate Transfer Belt 10]

[Preparation of Pellet]

A thermoplastic resin formed of polyvinylidene fluoride resin (KYNAR 721 from Arkema Japan), 5.0% by weight of the fibrous material and 7.0% by weight of carbon black were placed in a biaxial kneader (L/D=40), and melted and kneaded at 200° C. to prepare a resin pellet.

In Examples 7 and 8, 5.0% by weight of PTFE fine particles having a diameter of 3.0 μm were further added to the thermoplastic resin. In Example 8, a thermoplastic resin including 90% by weight of the polyvinylidene fluoride resin (KYNAR 721 from Arkema Japan) and 10% by weight of a conductive resin (Pelestat 6321 from Sanyo Chemical Industries, Ltd.) was used. The orientation angels was adjusted by changing extrusion quantity and belt drawing speed.

[Molding of Belt]

The pellet was placed in a hopper of a monoaxial extruder (L/D=38) and extruded from a circular dice having a diameter of 200 mm to mold a belt.

[Image Evaluation]

The belt was installed in a marketed printer from Ricoh Company, Ltd. to produce 10,000 images.

Good: No strip image in a belt travel direction

Poor: Stripe images were produced

The results are shown in Table 1.

TABLE 1

| | Example 1 | Example 2 | Example 3 |
|---|---|---|---|
| Thermoplastic Resin | Polyvinylidene Fluoride | Polyvinylidene Fluoride | Polyvinylidene Fluoride |
| Material for Fibrous Material | Polyester | Polyester | Polyester |
| Average Outer Diameter of Fibrous Material (μm) | 10 | 20 | 50 |
| Average Length of Fibrous Material (μm) | 220 | 440 | 980 |
| Conductive Agent | Carbon Black | Carbon Black | Carbon Black |
| Fine Particles | None | None | None |
| Orientation Angle Fa | 6.3 | 8.3 | 8.8 |
| Image Evaluation | Good | Good | Good |
| | **Example 4** | **Example 5** | **Example 6** |
| Thermoplastic Resin | Polyvinylidene Fluoride | Polyvinylidene Fluoride | Polyvinylidene Fluoride |
| Material for Fibrous Material | Cellulose | Cellulose | Cellulose |
| Average Outer Diameter of Fibrous Material (μm) | 10 | 20 | 50 |
| Average Length of Fibrous Material (μm) | 180 | 390 | 880 |
| Conductive Agent | Carbon Black | Carbon Black | Carbon Black |
| Fine Particles | None | None | None |
| Orientation Angle Fa | 7.8 | 8.0 | 8.1 |
| Image Evaluation | Good | Good | Good |
| | **Example 7** | **Example 8** | **Example 9** |
| Thermoplastic Resin | Polyvinylidene Fluoride | Polyvinylidene Fluoride | Polyvinylidene Fluoride |
| Material for Fibrous Material | Polyester | Cellulose | Polyester |
| Average Outer Diameter of Fibrous Material (μm) | 20 | 20 | 10 |

TABLE 1-continued

| | | | |
|---|---|---|---|
| Average Length of Fibrous Material (um) | 440 | 390 | 220 |
| Conductive Agent | Carbon Black | Carbon Black | Carbon Black |
| Fine Particles | Yes | Yes | None |
| Orientation Angle Fa | 12.3 | 14.3 | 30.0 |
| Image Evaluation | Good | Good | Good |

Comparative Example 1

The procedures for preparation and evaluation of the belt in Example 1 were repeated except for adding a fibrous material. The results are shown in Table 2.

Comparative Example 2

The procedures for preparation and evaluation of the belt in Example 1 were repeated except for setting the orientation angle Fa to be 45.0°. The results are shown in Table 2.

TABLE 2

| | Comparative Example 1 | Comparative Example 2 |
|---|---|---|
| Thermoplastic Resin | Polyvinylidene Fluoride | Polyvinylidene Fluoride |
| Material for Fibrous Material | — | Polyester |
| Average Outer Diameter of Fibrous Material (μm) | — | 20 |
| Average Length of Fibrous Material (μm) | — | 440 |
| Conductive Agent | Carbon Black | Carbon Black |
| Fine Particles | None | None |
| Orientation Angle Fa | — | 45.0 |
| Image Evaluation | Poor | Poor |

Tables 1 and 2 prove that an intermediate transfer belt including a fibrous material having an orientation angle Fa of from 5° to 30° capable of inhibiting scratches from being formed on an inner circumferential surface of the belt to suppress production of abnormal images.

Example 10

Coextrusion Molding of Double-Layered Belt

In order to improve the surfaceness (glossiness and friction coefficient) of a belt, each of a substrate layer including a fibrous material and a surface layer not including a fibrous material were placed in a die and subjected to a coextrusion molding by connected two monoaxial extruders to form a double-layered belt.

The resin pellet used in Example 8 was used for the substrate layer.

A pellet of polyvinylidene fluoride resin (KYNAR 720 from Arkema Japan) was used for the surface layer.

The fibrous material had an orientation angle of 14.3°, and the belt had good glossiness, a low friction coefficient and produced good quality images.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image bearer;

an electrostatic latent image former to form an electrostatic latent image on the image bearer;

an image developer to develop the electrostatic latent image formed on the image bearer to form a toner image;

an intermediate transfer belt comprising:

a thermoplastic resin; and a fibrous material, wherein the fibrous material has an orientation angle Fa of from 5° to 30° in a direction perpendicular to a circumferential direction of the intermediate transfer belt;

a first transferer to transfer the toner image on the image bearer onto the intermediate transfer belt;

a second transferer to transfer the toner image on the intermediate transfer belt onto a recording medium; and a fixer to fix the toner image on the recording medium.

2. The image forming apparatus of claim 1, wherein the orientation angle Fa is from 5° to 15°.

3. The image forming apparatus of claim 1, wherein the fibrous material is at least one of a natural fiber and a chemical fiber.

4. The image forming apparatus of claim 1, wherein the fibrous material has an average outer diameter of from 10 μm to 50 μm and an average length of from 200 μm to 1,000 μm.

5. The image forming apparatus of claim 1, wherein the intermediate transfer belt further comprises at least one of an organic and an inorganic particulate material having an average particle diameter of from 1 μm to 5 μm.

6. The image forming apparatus of claim 1, wherein the intermediate transfer belt further comprises a conductive resin which is a polymer having a polyether unit.

7. The image forming apparatus of claim 1, wherein the intermediate transfer belt further comprises two layers each including a thermoplastic resin formed by coextrusion.

* * * * *